US005408059A

United States Patent [19]

Goble

[11] Patent Number: 5,408,059

[45] Date of Patent: Apr. 18, 1995

[54] INLINE CIRCUIT BREAKER FOR ELECTRICAL EXTENSION CABLE

[76] Inventor: Robert H. Goble, 10757 William Tell Dr., Orlando, Fla. 32821

[21] Appl. No.: 96,190

[22] Filed: Jul. 26, 1993

[51] Int. Cl.[6] ..... H01R 4/50

[52] U.S. Cl. ..... 200/51 R; 439/341; 200/51.1; 200/51.11

[58] Field of Search ..... 200/51 R, 51.11, 51.09, 200/51.10, 51.12, 237, 293; 439/341

[56] References Cited

U.S. PATENT DOCUMENTS

| | | | |
|---|---|---|---|
| 366,654 | 7/1887 | Duby et al. | 200/511.11 X |
| 2,798,172 | 7/1957 | Jones | 200/51.11 X |
| 3,737,591 | 6/1973 | Parlato | 200/51 R X |
| 4,095,074 | 6/1978 | Lockard | 200/51.11 X |
| 4,438,303 | 3/1984 | Asher | 200/51.1 |
| 4,481,388 | 11/1984 | Gilliam et al. | 200/51 R |
| 4,485,282 | 11/1984 | Lee | 200/51 R |
| 4,691,978 | 9/1987 | Lemmer | 200/51 R X |
| 5,070,219 | 12/1991 | Grosskruger et al. | 200/51 R X |
| 5,104,331 | 4/1992 | Goble | 439/341 |

*Primary Examiner*—Ernest G. Cusick
*Attorney, Agent, or Firm*—James H. Beusse

[57] ABSTRACT

The present invention is illustrated in one form as an inline electrical circuit breaker system for an electrical extension cable comprising an intermediate coupler having opposite end terminals adapted for electrically coupling a female terminal of a first electrical cable to a male terminal of a second electrical cable. A recess is formed in the coupler and has a pair of opposite end walls, the recess being adapted for receiving a circuit breaker. A first power bus segment extends from one of the opposite end terminals through an adjacent one of the opposite end walls and partially into the recess. A second power bus segment extends from another of the opposite end terminals through an adjacent one of the pair of opposite end walls and partially into the recess. The circuit breaker includes terminals for coupling the first and second power bus segments for establishing a current path through the coupler when the breaker is installed in the recess.

6 Claims, 2 Drawing Sheets

INLINE CIRCUIT BREAKER FOR ELECTRICAL EXTENSION CABLE

BACKGROUND OF THE INVENTION

The present invention relates to relatively high current electrical extension cables and, more particularly, to a coupling system for large, temporary electrical cables which incorporate inline circuit breakers.

High current electrical extension cables are used in various temporary applications such as, for example, building construction, lighting systems for motion picture production, carnivals and outdoor entertainment productions. A typical cable may be rated at 100 amperes and be formed of three No. 2 conductors, triple insulated such that the outer diameter of the cable is about 1.25 inches. It is common for such cables to be connected in multiple segments with each segment being 50, 75 or 100 feet in length. It is not uncommon for such cables to be damaged at their end connectors and exhibit short-circuit conditions which can lead to a hazardous situation. Further, such cables are often connected and disconnected while "hot", i.e., while power is applied, creating a hazard to the person handling the connectors.

U.S. Pat. No. 5,104,331 discloses a connector for such cables which is uniquely adapted to prevent accidental separation and to assure that electrical connections are made and broken in a prescribed order, i.e., ground in made first and broken last. While this connector overcomes many of the problems associated with prior art connectors, it does not address the ability to remotely interrupt power under excessive current or short-circuit conditions nor when it is desired to connect or disconnect additional cables to an existing cable.

SUMMARY OF THE INVENTION

It is an object of the present invention to provide for remote power interruption in a temporary electrical extension cable.

The present invention is illustrated in one form as an inline electrical circuit breaker system for an electrical extension cable comprising an intermediate coupler having opposite end terminals adapted for electrically coupling a female terminal of a first electrical cable to a male terminal of a second electrical cable. The term circuit breaker is intended to include current interrupting devices including manual switches, ground fault interrupters and conventional over-current circuit breakers. A recess is formed in the coupler and has a pair of opposite end walls, the recess being adapted for receiving a circuit breaker. A first power bus segment extends from one of the opposite end terminals through an adjacent one of the opposite end walls and partially into the recess. A second power bus segment extends from another of the opposite end terminals through an adjacent one of the pair of opposite end walls and partially into the recess. The circuit breaker includes terminals for coupling the first and second power bus segments for establishing a current path through the coupler when the breaker is installed in the recess.

The circuit breaker is held in operative position in the recess by a pair of spring catches mounted in the opposite end walls. The breaker is removed by depressing the spring catches. Preferably, a spring positioned in the bottom of the recess and aligned with and compressed by the circuit breaker when the circuit breaker is in an assembled position assists in removing the breaker by pushing the circuit breaker outwardly of the recess when the catches are depressed.

The system can be extended to multiphase use by enlarging the recess to receive a plurality of circuit breakers for coupling respective pairs of first and second power bus segments.

BRIEF DESCRIPTION OF THE DRAWINGS

For a better understanding of the present invention, reference may be had to the following detailed description taken in conjunction with the accompanying drawings in which.

DETAILED DESCRIPTION OF PREFERRED EMBODIMENTS

Figure 1:
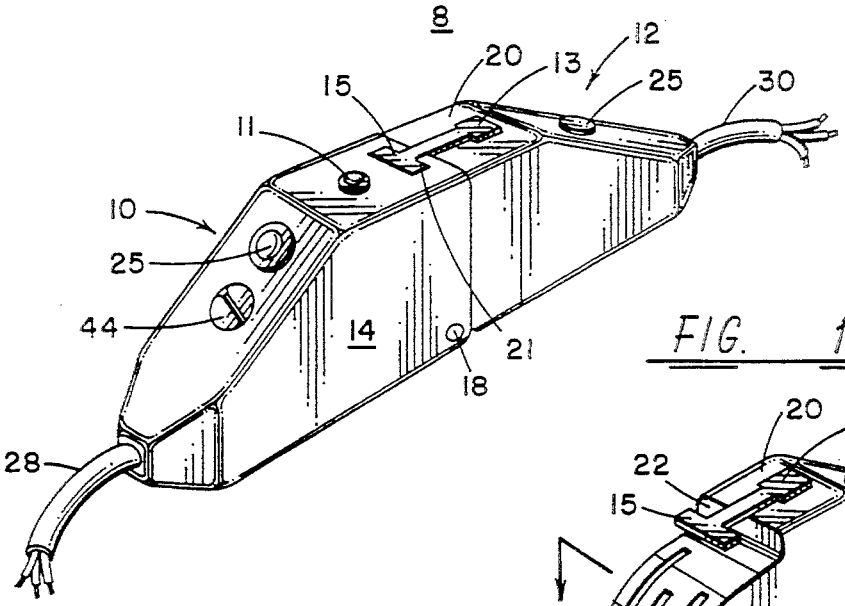
FIG. 1 illustrates one form of connector for high-power extension cables.
Figure 2:
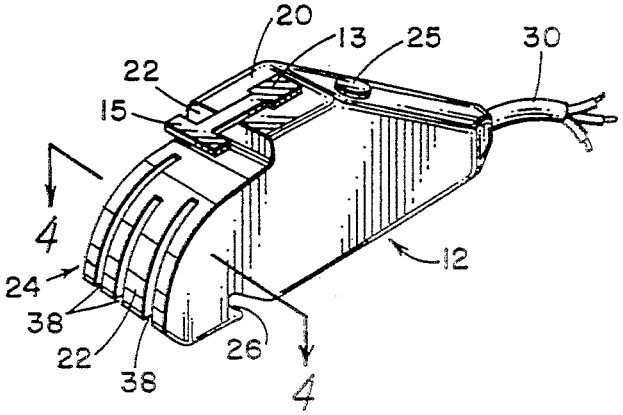
FIGS. 2 and 3 are female and male sections of the connector of FIG. 1.
Figure 3:
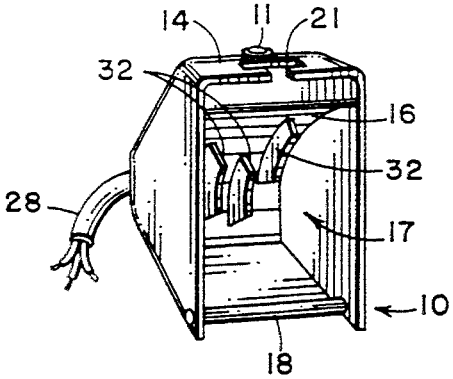

Referring now to FIGS. 1, 2 and 3, there is seen one form of cable connector 8 with which the present invention may be used. The connector 8 comprises a female connector component 10 and a male connector component 12. Component 10 and 12 include external housings 14 and 20. Multi-conductor cables 28 and 30 enter housings 14 and 20, respectively, substantially in line with pin 18, so that the components cannot be inadvertently separated by pulling on the ends of cables 28 and 30, as detailed below.

A spring latch 13 having an enlarged, here "T" shaped, head 15 and a spring end 19 hingedly attached to housing 20 cooperates with a corresponding "T" shaped notch 21 in housing 14 to hold the connector in the closed position. To open the latch, the end of pivot lever 11 is pressed downward causing the opposite end to press against the under surface of end 15 against the bias of spring at end 19, causing head 15 to be forced up and out of notch 21, allowing male component 12 to be rotated about pin 18 to open the connector.

A light 25, such as a light emitting diode, may be mounted on either housing 14 or 20 or both, as shown, with leads to the ground and hot connection, to signal that the connector is in operation.

As seen in FIG. 2, male component 12, within housing 20, contain a block 22 substantially filling the housing and having a convex surface 24 that is a surface of revolution substantially conforming to concave surface 17 of female component 10, as seen in FIG. 3. A pair of notches 26 in housing 20 have a width conforming to the diameter of pin 18, with the bottom of the notch lying at the axis of the convex surface.

Conventional electrical cables 28 and 30 enter the ends of blocks 16 and 22, respectively, opposite the curved surfaces in line with pin 18. Wires within these cables are connected to contacts on the curved surfaces, as detailed below. The cables may be secured to housings 14 and 20 by conventional cable clamps attached to the housings, if desired. Alternatively, the cables could be molded with, or adhesively bonded to, the housings and/or blocks during manufacture to form a unitary structure.

Alternatively, housings 14 and 20 could be formed integrally with blocks 16 and 22, respectively, depending upon the material (such as a solid injection moldable plastic) chosen for those portions. In the embodiment shown, housings 14 and 20 are formed from metal, high strength plastic or the like and blocks 16 and 22 are semi-rigid foam, such as a polyurethane foam which may be separately formed and inserted in the housings or, preferably, foamed in place.

FIGS. 2 and 3 show perspective views of the curved surfaces 17 and 24, showing the location of contacts 32 and 34, respectively. Contacts 32 preferably are positioned each on a side of a raised land 36 or extend along concave surface 17 above that surface, while contacts not shown are positioned at the sides of corresponding grooves 38. This cooperating set of lands and grooves helps assure proper transverse alignment of contacts 32 and 34 as the connector is closed. Preferably, there is a slight interference fit between the contacts 32 and 34 as the connector is closed, to assure tight, pressure contact between the contacts. As can be best seen in FIG. 3, one contact 32, that selected to be the ground contact, is positioned so that contact is engaged prior to engagement of the hot contacts.

Figure 4:
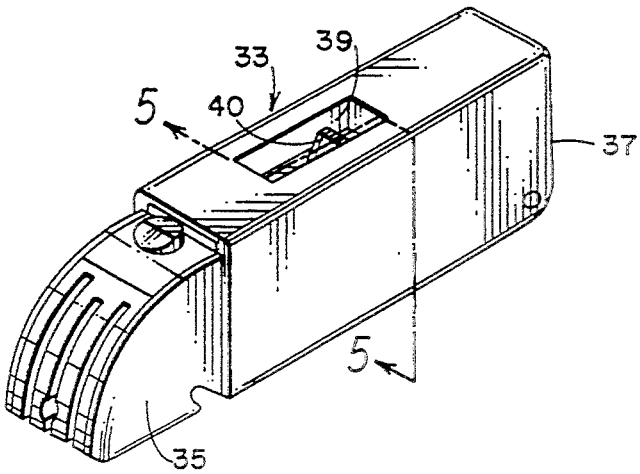
FIG. 4 is an illustration of one form of coupler according to the present invention for use with the connector of FIG. 1.

FIG. 4 is a perspective view of an electrical coupler 33 in accordance with the present invention which may be used with the connector 8 of FIG. 1. The coupler 33 incorporates a male connector end 35 and a female connector end 37. A recess 39 is formed in the upper surface of coupler 33 for receiving a conventional circuit breaker 40.

Figure 5:
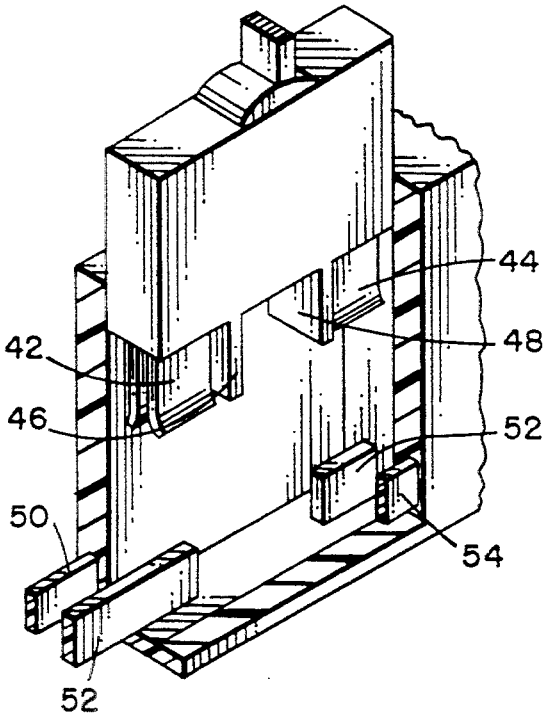
FIGS. 5 and 6 are cross-sectional views of the coupler of FIG. 4 with circuit un-installed and installed, respectively.

FIG. 5 is a partial cross-sectional view taken through the recess 39 along line 5—5. The breaker 40 is illustrated as a type having a pair of spaced bayonet type receptacles 42, 44 separated by a pair of spaced insulating tabs 46, 48. The breaker 40 may be selected from any of several conventional types available from General Electric Co., Square-D Corp., as well as others, and may be of suitable current rating, e.g., 50, 100 or other amperage.

Within the body of coupler 33, bus bars 50, 52 and 54 extend from the connector end 35 to the connector end 37. The bus bars 50 and 54 are embedded in the plastic material of the coupler 33. Bus bar 52 is interrupted at the recess 39. In practice, bars 50 and 54 in a three wire system are ground and neutral return. Bar 52 represents the "hot" line. The two bar segments making up bar 52 are sized to fit into the bayonet type receptacles of breaker 40. Consequently, bus 52 is "fused" or protected by breaker 40 when breaker 40 is full pressed into recess 39.

Figure 6:
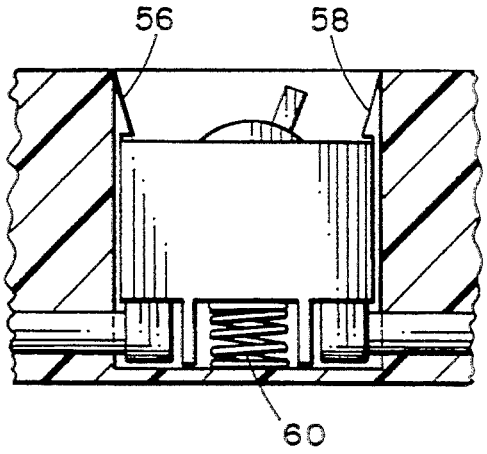

Referring to FIG. 6, there is shown a simplified side view of FIG. 5 with breaker 40 fully positioned in recess 39. Breaker 40 is retained in recess 39 by a pair of spring members 56, 58 mounted to the end walls of recess 39. Breaker 40 is removable from recess 39 by depressing the spring members 56, 58 against the end walls of recess 39. To assist in removing breaker 40, a coil spring 60 is positioned in the bottom of recess 38 spaced from each of the ends of bus bar 52. The spring 60 may be attached to the bottom surface of recess 39 by adhesive or other suitable means to prevent the spring from contacting the bar 52.

Figure 7:
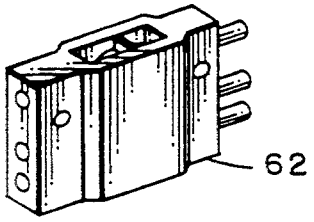
FIGS. 7 and 8 are exemplary forms of a coupler of the present invention for use with other types of connectors.
Figure 8:
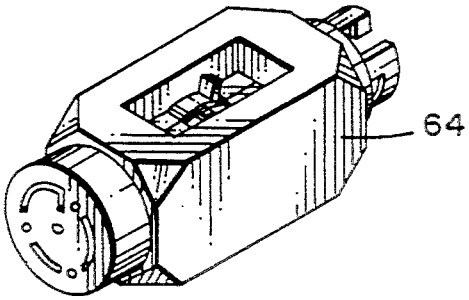

The system of FIGS. 4–6 may also be used in other types of high-current connector couplers. FIGS. 7 and 8 illustrate two other couplers 62 and 64 which are equivalent to coupler 33 but designed for interfacing with a conventional pin-type connector and a conventional twist-lock connector, respectively.

Figure 9:
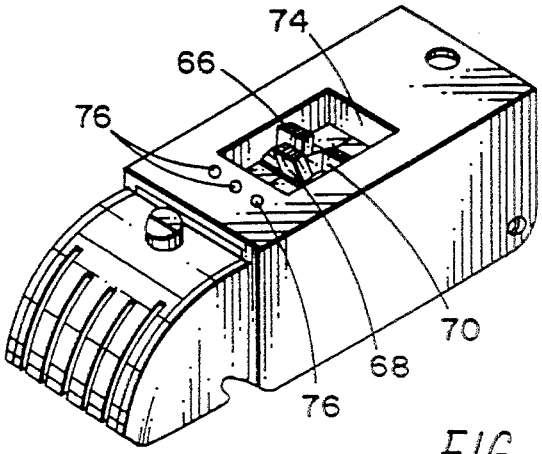
FIG. 9 illustrates the coupler of the present invention in a multiphase arrangement.

The system of FIGS. 4–6 can also be expanded to multiphase connectors as shown in FIG. 9. Coupler 66 is adapted for three-phase use and includes three separate breakers 68, 70 and 72. Coupler 66 is substantially identical to the coupler of FIGS. 4–6 except for having a wider recess 74 to accommodate three breakers for the three bus bars associated with a three-phase system.

While the invention has been described in what is presently considered to be a preferred embodiment, many variations and modifications will become apparent to those skilled in the art. For example, the coupler may include indicator lights as shown at 76 for indicating the status of the breakers 68, 70 and 72, such lights being connected as shown in applicant's prior U.S. Pat. No. 5,104,331. Accordingly, it is intended that the invention not be limited to the specific illustrative embodiment but be interpreted within the full spirit and scope of the appended claims.

What is claimed is:

1. An inline electrical circuit breaker system for an electrical extension cable structure including a first electrical extension cable having a female terminal and a second electrical extension terminal having a male terminal; the circuit breaker system comprising;

an intermediate coupler having opposite end terminals adapted for electrically coupling said female terminal of said first electrical extension cable to said male terminal of said second electrical extension cable;

a circuit breaker;

a recess formed in said coupler and having a pair of opposite end walls, said recess being adapted for receiving said circuit breaker;

a first power bus extending from one of said opposite end terminals through an adjacent one of said opposite end walls and partially into said recess;

a second power bus extending from another of said opposite end terminals through an adjacent one of said pair of opposite end walls and partially into said recess; and means for coupling said first and second power buses to said circuit breaker for establishing a current path through said coupler.

2. The system of claim 1 and including means for releasably latching said circuit breaker into said recess.

3. The system of claim 2 and including means for ejecting said circuit breaker from said recess upon release of said latching means.

4. The system of claim 3 wherein said latching means comprises at least one spring catch mounted in one of said pair of opposite end walls.

5. The system of claim 3 wherein said ejecting means comprises a spring positioned in a bottom of said recess and aligned with and compressed by said circuit breaker when said circuit breaker is in an assembled position in said recess whereby release of said latching means allows said spring to push said circuit breaker outwardly of said recess.

6. The system of claim 1 and including a plurality of pairs of first and second power buses extending into said recess and a corresponding plurality of circuit breakers adapted for installation in said recess for coupling respective pairs of said first and second power buses.

* * * * *